United States Patent [19]

Wüthrich

[11] 4,022,126

[45] May 10, 1977

[54] LETTER PRESS PRINTING PRESS

[75] Inventor: Werner Wüthrich, Gumligen, Switzerland

[73] Assignee: Autelca, AG, Gumligen, Switzerland

[22] Filed: May 4, 1976

[21] Appl. No.: 683,052

[30] Foreign Application Priority Data

May 5, 1975 Switzerland ..... 5731/75

[52] U.S. Cl. ..... 101/269

[51] Int. Cl.[2] ..... B41F 3/20

[58] Field of Search ..... 101/269, 282, 283, 284, 101/285, 56

[56] References Cited

UNITED STATES PATENTS

| | | | |
|---|---|---|---|
| 3,739,718 | 6/1973 | Zupancic | 101/269 X |
| 3,768,404 | 10/1973 | Holouka, Jr. | 101/269 |
| 3,795,191 | 3/1974 | Miller et al. | 101/269 |

*Primary Examiner*—J. Reed Fisher

*Attorney, Agent, or Firm*—Brady, O'Boyle & Gates

[57] ABSTRACT

A roller cage having at least one needle roller on one side and larger rollers having axes parallel thereto on the other side, a print transfer plate having a reciprocal sliding drive means extending through the roller cage with opposite sides in contact with the respectively oppositely disposed rollers, the larger rollers adapted to roll on a plate disposed parallel to a printing form, which plate has lateral recessed grooves into which the rollers roll prior to and after the printing operation to increase the distance between the needle roller and the printing form for inserting sheets to be printed and removing printed sheets which are pressed against a dye support and printing form by the needle roller during the printing process, and an inclined plane and stop mechanism functioning to raise and lower said plate as it moves back and forth under the influence of the reciprocating print transfer plate during the printing operation.

2 Claims, 5 Drawing Figures

LETTER PRESS PRINTING PRESS

BACKGROUND OF THE INVENTION

Field of the Invention

The present invention relates to a letterpress printing press wherein one or more stacked sheets, which each have a surface which changes color when pressure is applied (so-called active paper) or which each come into contact with an ink film support comprising a layer, which rubs off under the influence of pressure (dye band, carbon paper), are pressed against a letter press form by the printing progress of at least one cylindrical roller element in a combined pressure-applying and rolling movement.

In the printing industry, the term printing progress refers to the rolling movement of the impression cylinder on the printing form.

In the known machines of this type, the cylindrical roller is mounted in journal bearings which, to permit printing progress, are displaceably guided, are equipped with a sliding drive system, are capable of bearing a compressive load for the application of pressure, and can be raised from the printing form in order to insert and remove the sheet or sheets. Complicated mechanisms having relatively large dimensions in the direction in which pressure is exerted, were required for this purpose.

SUMMARY AND OBJECT OF THE INVENTION

In the device according to the invention, a roller cage comprises at least one needle-shaped roller body on one side and rollers having axes parallel thereto, disposed on the other side of a print transfer plate equipped with a sliding drive means, and the rollers roll on a path, which is parallel to the form and which is equipped with grooves into which the rollers roll prior to and after the printing operation, in order to increase the distance between the needle-shaped rollers and the printing form for the purpose of inserting the sheets to be printed and removing the printed sheet or sheets. Oppositely disposed spur wheels comprising straight teeth are mounted at the sides of the roller cage parallel to the direction of displacement of the print transfer plate. The aforementioned spur wheels mesh with cog-racks attached, on the one hand, to the print transfer plate and, on the other hand, connected to the path; the length of the teeth being such that the spur wheels mesh with the cog-racks connected to the path even when the rollers are in the grooves.

The drawing represents an embodiment of the invention which will be described in more detail hereinafter.

DESCRIPTION OF THE PREFERRED EMBODIMENT

Figure 1:
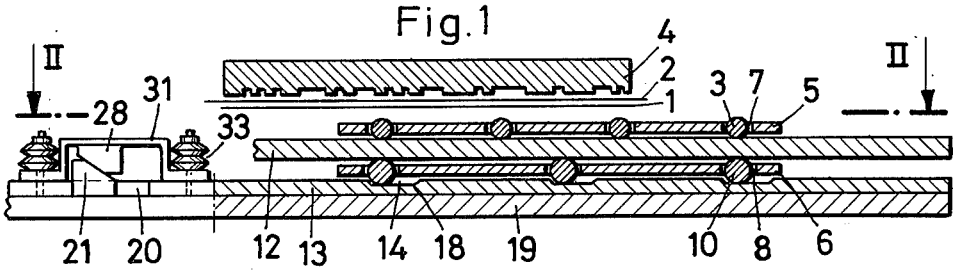
FIG. 1 is a partial sectional front view of the essential parts of a letterpress printing press according to the invention taken substantially on line I—I of FIG. 2.

In the machine represented in FIG. 1, a sheet 1 to be printed, above which a dye band, dye transfer sheet, dye film support, etc, 2 is located, is pressed against a letterpress form 4, disposed thereabove, by the application of pressure on the part of four needle roller elements 3. To effect this, the rollers 3 are first raised from the position represented in FIG. 1, to the underside of the sheet 1, and then rolled against the latter.

Figure 2:
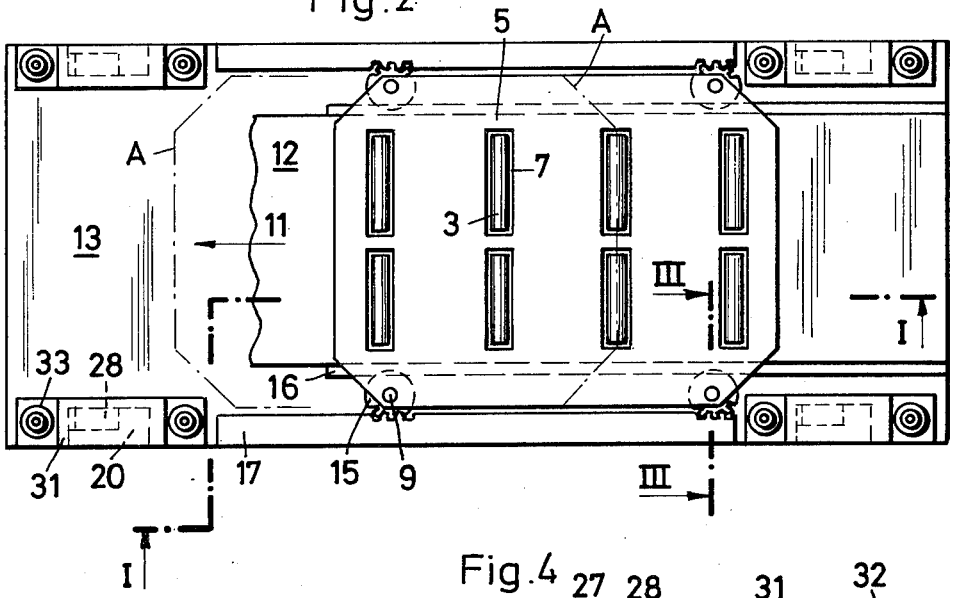
FIG. 2 is a top plan view taken substantially along the line II—II of FIG. 1.

According to FIGS. 1 and 2, two parallel plates 5 and 6, which are equipped with parallel slots 7 and 8 and which are rigidly connected together with specific mutual spacing by means of bolts 9 (FIG. 3) form a roller cage for the needle rollers 3 disposed in the slots 7 and the rollers 10 disposed in the slots 8. The needle rollers 3 roll on the upper surface of a print transfer plate 12, which is displaceable in the direction 11. The rollers 10 roll on the underside of the print transfer plate 12 and on the upper side of a plate 13. Disposed parallel to the plate 13 above the needle rollers 3, is the sheet 1 to be printed, thereabove the dye band 2, and above the latter the letterpress printing form 4. In the position of the movable parts, represented in FIGS. 1 to 4, the rollers 10 are disposed in the grooves 14 of the plate 13; these grooves being broader at their upper part and extending parallel to the axes of the rollers and laterally of the direction of movement of the rollers and plate 12.

The print transfer plate 12 is reciprocally displaceable by means of a sliding device (not represented) from the position indicated in FIGS. 1 and 2 in the direction 11 and thereafter in the opposite direction back into the position represented. During this displacement movement, the rollers 10 first roll out of the grooves 14, which have inclined sides 18, and then onto the flat upper surface of the plate 13 and then again roll down into the grooves 14 at the end of the return movement. As a result, the needle rollers 3 are disposed at a greater distance from the printing form 4 and the dye band 2 prior to and after application of pressure, and at a shorter distance therefrom when pressure is being applied. The greater spacing enables the sheet 1 to be inserted between the dye band 2 and the needle rollers 3, and to be removed therefrom. When the distance is shorter, the needle rollers 3 press with a pressure which is appropriate for the printing process against the back of the sheet 1 in the manner described hereinafter with reference to FIGS. 4 and 5.

Figure 3:
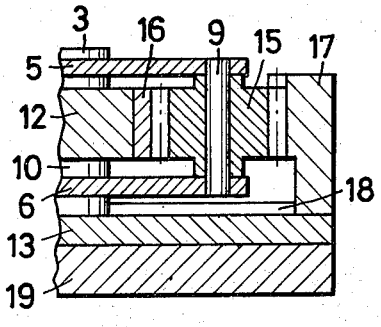
FIG. 3 is a fragmentary cross-view, on an enlarged scale and taken substantially along the line III—III of FIG. 2.

According to FIG. 3, spur wheels 15 having straight teeth are mounted on the bolts 9. The aforementioned wheels engage, on the one hand, with cog racks 16 which are attached to the edges of print transfer plate 12 and, on the other hand, with cog racks 17, which are connected to the plate 13 on opposite sides of the path of movement of the roller cage and plate 12. The cog racks 16 and 17 extend parallel to the direction 11, and the spur wheels 15 are disposed in pairs at right angles to the direction 11. The tooth length of the teeth of the spur wheels 15 and the cog racks 17 is such that the spur wheels 15 and the cog racks 17 mesh together irrespective of whether the rollers 10 are in the grooves 14 or are rolling on the flat part of the plate 13. By means of the spur wheels 15 and the cog racks 16 and 17, the roller cage 5 – 9 is compulsorily driven at half the rate of the print transfer plate 12 during displacement of the latter, and thus it also retains the correct position even after numerous forward and backward movements. In addition, the rollers 10 are thereby forced to roll upwards on the inclined sides 18 of the grooves 14. The position in which the roller cage 5 – 9 is located at the end of its movement (direction of movement 11) is represented by the dot dash line in FIG. 2 and designated by reference A.

Figure 4:
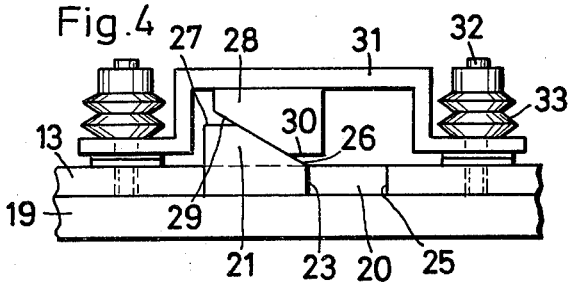
FIGS. 4 and 5 are front elevational views on an enlarged scale of a fragmentary portion of FIG. 1 showing the mechanism in two different positions.
Figure 5:
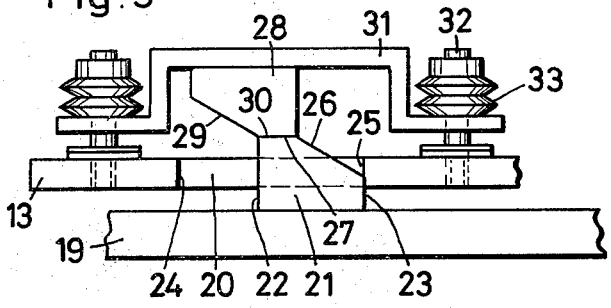

As represented in FIGS. 1 and 4, the plate 13 is disposed on a base plate 19 when the rollers 10 are in the grooves 14. At the ends of its longitudinal edges extending parallel to the direction 11, the plate 13 has apertures 20 therethrough through which sliding elements 21 secured to the base plate 19 are adapted to project. The sliding elements 21 extending through the apertures or slots 20 guide the plate 13 in its longitudinal direction and are provided with abutment faces 22 and 23 which limit this longitudinal movement of the plate 13 on a path which is slightly larger than the breadth of the grooves 14, since at the ends of this path of movement the abutment faces 22 or 23 are abutting against the end transfer edges 24 or 25 of the apertures 20, as represented in FIGS. 4 and 5. The sliding elements 21 each include a sliding face 26 inclined in the direction 11 with respect to the plate 13 and an adjacent top sliding face 27 parallel to the plate 13. The sliding face 26 and the sides 18 of the grooves 14 possess the same angle of inclination of 30°. Disposed above each sliding element 21 is a cooperating sliding element 28, which has sliding faces 29 and 30 corresponding to the sliding faces 26 and 27 of the sliding element 21. The sliding elements 28 are each attached to a yoke 31 displaceable on bolts 32 which are attached to the plate 13 at right angles to the same. In the position represented in FIGS. 1 and 4, the yokes 31 are pressed by plate springs 33 against the plate 13 so that the inclined sliding faces 26 and 29 are in contact with one another and the abutment faces 22 abut against the transverse edges 24 of the apertures 20 of plate 13.

The length of the inclined sliding faces 26 and 29, the initial biasing of the springs 33, the ratio of the depth of the grooves 14 to the diameter of the rollers 10 and the inclination of the sides 18 and of the sliding faces 26 and 29 are so adjusted that the plate 13 is displaced and the sliding elements 28 with their inclined sliding faces 29 slide upwards on the inclined sliding faces 26 of the sliding element 21 until the sliding faces 27 and 30 are in contact with one another when the rollers 10 roll out of the grooves 14 onto the flat part of the plate 13 through displacement of the print transfer plate 12. Upon termination of this sliding movement of the sliding elements 21 and 28, the abutment faces 23 abut against the transverse edges 25, and the yokes are slightly raised from the plate such that the springs 33 urge or press the plate 13 upwards and thus exert the requisite pressing force for the printing process (FIG. 5) and during the continued movement of the print transfer plate 12, the rollers 10 roll over the flat part of the plate 13 and the needle rollers 3 roll on the back of the sheet 1. Owing to the arrangement of the sliding elements 21 and 28, the space for insertion of the sheet 1 formed between the needle rollers 3 and the dye band 2 or the printing form 4 is considerably enlarged and the insertion of a larger number of sheets comprising intermediate layers of carbon paper or sheets of active paper is made possible. Owing to the flexibility of the springs 33, the position of the plate 13 is adapted over a relatively large zone to the total thickness of the stacked sheets. In addition, the base plate could also be adjusted, for example, raised or lowered.

The terms and expressions which have been employedherein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A letterpress printing press in which one or more stacked sheets, which each have a surface which changes color under the influence of pressure or which each come into contact with a dye film support comprising a layer which is rubbed off under the influence of pressure, are pressed against a printing form by the application of pressure by at least one cylindrical roller, comprising a roller cage, a print transfer plate equipped with sliding drive means, at least one needle-shaped roller mounted in said cage on one side of said print transfer plate and rollers whose axes are parallel to that of the needle-shaped roller mounted in said cage on the other side of said print transfer plate, a plate connected parallel to the printing form, said last mentioned rollers connected to roll on said plate parallel to the printing form, said plate having lateral grooves into which the rollers are adapted to roll prior to and after the printing operation in order to increase the space between the needle-shaped rollers and the printing form for the purpose of inserting the sheet or sheets to be printed and for removing the same, and oppositely disposed spur wheels which include straight teeth are mounted on the sides of said roller cage parallel to the direction of displacement of the print transfer plate, cog-racks attached to the print transfer plate, cog-racks connected to said plate, said spur wheels meshing with said cog-racks on said print transfer plate and with said cog-racks on said plate and the tooth length of the said straight teeth being such that said spur wheels mesh with the cog-racks connected to said plate even when said rollers are in the lateral grooves.

2. A press as set forth in claim 1, in which said plate is movable by a distance limited by two stops in the direction of displacement of the print transfer plate and is equipped with sliding elements supported by prestressed springs, said sliding elements having sliding faces which are inclined with respect to said plate in the direction of displacement of the print transfer plate and adjacent sliding faces which are parallel to said plate, having correspondingly inclined sliding faces cooperating with said first mentioned inclined sliding faces, the inclined sliding faces of the cooperating sliding elements and stationary sliding elements being in contact with one another, and the plate abutting against one of the stops when the rollers are in the grooves, this entire operating step being carried out in such a way that the cooperating sliding elements slide on their mating inclined sliding faces and then on their mating sliding faces parallel to the plate until the plate abuts against the other stop, and said springs are stressed additionally to the initial biasing when the rollers roll over the sides of the grooves onto the flat face of the plate through the displacement of the print transfer plate.

* * * * *